US007799982B2

(12) United States Patent
Stannard

(10) Patent No.: US 7,799,982 B2
(45) Date of Patent: Sep. 21, 2010

(54) QUICK CHANGE RATTLE SUSPENDABLE PERCUSSION INSTRUMENTS

(76) Inventor: John Stannard, 2140 Range Rd., Unit C, Clearwater, FL (US) 33765

( * ) Notice: Subject to any disclaimer, the term of this patent is extended or adjusted under 35 U.S.C. 154(b) by 0 days.

(21) Appl. No.: 11/924,787

(22) Filed: Oct. 26, 2007

(65) Prior Publication Data

US 2008/0105103 A1 May 8, 2008

Related U.S. Application Data

(60) Provisional application No. 60/856,957, filed on Nov. 6, 2006.

(51) Int. Cl.
*G10D 13/08* (2006.01)

(52) U.S. Cl. ..... 84/422.1; 84/402; 84/411 R

(58) Field of Classification Search ..... 84/422.1
See application file for complete search history.

(56) References Cited

U.S. PATENT DOCUMENTS

| | | | | |
|---|---|---|---|---|
| 4,114,502 | A * | 9/1978 | Zildjian | 84/402 |
| 4,807,510 | A * | 2/1989 | Croteau | 84/402 |
| 5,915,289 | A * | 6/1999 | Hart | 84/738 |
| 5,922,980 | A * | 7/1999 | Arteaga | 84/411 M |
| 2006/0249004 | A1 * | 11/2006 | Bunker et al. | 84/410 |

* cited by examiner

*Primary Examiner*—Jeffrey Donels
*Assistant Examiner*—Christopher Uhlir
(74) *Attorney, Agent, or Firm*—Allan Dyer Doppelt Milbrath & Gilchrist

(57) ABSTRACT

A hybrid percussion instrument which is suspendable and can be used as a quick change rattle instrument in combination with other percussion instruments such as a cymbal.

12 Claims, 2 Drawing Sheets

QUICK CHANGE RATTLE SUSPENDABLE PERCUSSION INSTRUMENTS

RELATED APPLICATION

This application claims the benefit of U.S. Provisional Patent Application 60/856,957 filed Nov. 6, 2006.

FIELD OF THE INVENTION

The invention relates to percussion instruments, in particular to quick change suspended percussion instruments.

BACKGROUND OF THE INVENTION

By way of background to further understand the invention described hereinafter, the following definitions are provided.

Bronze: As defined here shall comprise any metal in which copper is alloyed with other elements to alter its properties. Such alloys include but are not limited to: phosphor/tin bronzes, high tin bronzes known as "bell" bronze, nickel bronze, nickel silver (a copper-nickel-zinc alloy), aluminum bronze, titanium bronze, beryllium copper, brass (brass is sometimes referred to as a bronze, but it shall included in the bronze class here).

Node: A point or area in a vibrating material or musical instrument where less vibration or very little vibration occurs.

Overtones: Overtones can be heard as simpler or individual tones or frequencies/vibrations which, when combined, make up the whole of a musical sound. The sum of simple sounds such as sine waves, rising and falling in amplitude and frequency can produce a complex sound. In percussion instruments, there is a complex matrix of overtones comprising the whole.

Swell: A term in music and in describing cymbal and percussion sound, whereby after the instrument is struck, sound grows over time from low to high amplitude. In cymbals (especially those known as crash cymbals), gongs and hybrid instruments, a rise in the frequency and complexity or number of overtones accompanies the rise in amplitude. Instruments with a relatively slow rise to full amplitude are deemed to have a greater degree of swell versus those instruments with a fast rise in amplitude.

Hybrid Instrument: As defined here, an instrument which, due to specific forming techniques, shapes, and materials, is suspended in ways similar to a gong while producing sounds similar to both cymbals and gongs, as well as new and novel sounds. Such an instrument can be embodied in a variety of shapes, not limited to shapes resembling gongs. The defining factors are that such instruments are suitable to be struck by drumsticks, are suspended from flexible members such as cord, chain or cable at points other than the center node of a disc or dome shape as in cymbals and that these instruments are capable of complex mid and or high frequency overtone structure similar to cymbals as well as low pitch swell as found in gongs.

Attack: The sound heard immediate after the striking of a percussion instrument. The attack is also defined as amount of time it takes for the sound of a percussion instrument to reach full volume or amplitude after a single strike. For example, an instrument with a large amount of swell (such as a large gong or cymbal struck with a soft mallet) would have a slow attack, while an instrument such as a bell struck with a metal clapper or a triangle would have a fast attack.

Hum note: In percussion instruments, such as large bells, cymbals, and gongs, as well as hybrid instruments, there exists a low frequency sound which is, depending on the instrument, loud or soft in amplitude. In cymbals this note is much lower in frequency than the accompanying overtones, and is ideally much lower in amplitude. Some cymbal makers seek to reduce the amplitude of the hum note as it can interfere with the low frequency spectrum of music. String, wind and other non-percussive instruments, feature a low note called a fundamental tone which is the basis for a series of overtones, which are in frequency based on precise integer multiples of this fundamental, and are thus regarded as being "in tune." The hum notes and the overtones of cymbals, gongs and hybrid instruments are not integer based, or tuned to a specific pitch and are thus "not in tune."

Differences Between Gong and Cymbal Sounds:

Prior gong designs share several features in common:

1. Gongs are suspended in an area near the outer edge from a flexible member such as rope, cord, gut, or cable.

2. Gongs, even when played with a drumstick, don't sound like cymbals. A drummer or percussionist would almost never mistake the sound of a gong for that of a cymbal. While part of the sound can be described and quantified (gongs have more pronounced low frequencies), the musician's ear proves to be the best measure of the difference.

3. Gongs often have a center area which is thinner in cross section or "gauge" than outer edge. Gongs also often have a distinct bent flange with encircles the entire outer edge. This flange tends to stiffen the outer area of the gong. This contributes to the gongs distinct sound. This flange is not present in all gongs but when it is omitted, other factors such as the distinct "bow" or curve and the thinned center render the instrument recognizable in sound as a gong.

4. The hum note in gongs is more pronounced than in cymbals. The hum note is an integral part of the gong sound.

5. Gongs primarily emit vibrations in the low to mid frequency range. Gongs emit only weak high frequency vibrations.

6. Gongs in general are not played with drumsticks, as the resulting sound would be generally unacceptable to percussionists and drummers.

Prior cymbal designs share two things in common:

1. Cymbals all feature a node in the center of the instrument. This area of little or no vibration has been the only acceptable area for mounting on a stand or suspending from a cord or strap.

2. Cymbals produce vibrations mostly in the mid to high frequency range. While a low frequency spectrum or note (known as a hum note) is produced, this sound is often found to interfere with the tuned instruments that it accompanies. Cymbal makers have attempted to reduce the amplitude of this hum note to acceptable levels, but it has often remained quite audible in intimate settings.

While these descriptions are informative, the musician's ear is the most valuable tool in discerning the difference between instrumental sound.

SUMMARY OF THE INVENTION

Generally, the invention comprises a section of metal, forming a hybrid novel percussive musical instrument, which takes on the appearance at first visual inspection, of a type of gong. The invention can create novel cymbal-like sounds.

The instrument is suspended from one or more holes, hooks, or suspension points in a manner similar to gongs, but differs from gongs in the following ways which cause it to yield sound recognizable as the sound closer to that of a cymbal:

1. The instrument is curved along a slight dome shape in a radius similar to that of cymbals rather than gongs.

2. In or near the center of the instrument, a large hole is created. In some embodiments a series of slots or patterns of small holes are made near the center area which affect sound in ways similar to the large center hole.

3. The thickness of the instrument in some embodiments is tapered to be thicker in the middle area, and progressively thinner toward the outer edge.

These features can be utilized in various combinations to form a novel hybrid cymbal instrument.

The invention is readily suitable for playing with drumsticks, and even when hit with small gongs mallets, it still produces sound in the cymbal spectrum.

Control of Unwanted Low Frequencies or "Hum Notes":

A feature of conventional cymbals and gongs is the presence of one or more mid to low frequency notes known as "hum notes". These tones can stand out and, since they are usually out of tune, interfere with musical harmony. Gongs feature one or more low frequency hum notes which are quite prominent. They are an integral part of the sound of a gong. Cymbals feature a hum note, but cymbal makers often seek to reduce the amplitude of the hum note as it can interfere with vocal and instrumental passages in music.

A distinctive feature of this invention is the reduction in volume and frequency and in some cases the complete obliteration of the "hum note" present in cymbals (and quite prominent in gongs). The greater the size of the middle hole, the greater the reduction in hum note amplitude. The middle hole should be at least 2 inches in diameter or 15% of the total diameter of the instrument. If the hole is too large, the instrument will begin to lose the sound qualities of a cymbal. To retain a cymbal-like sound, the center hole diameter should range between 15% and 50% of the overall diameter of the instrument.

The location of this hole also affects sound. The greatest reduction in hum note is achieved by placing the hole in the center. The hole can be placed off center, but to retain a cymbal-like sound and reduce the amplitude of the hum note, the hole must be in close proximity to the center area of the instrument. Best results are achieved when the hole eclipses the center area.

Overtone structure is also affected by hole placement. A large hole will reduce the amplitude of low to mid frequencies and retain a complex series of overtones in the high frequency spectrum.

In some embodiments a series of slots or patterns of small holes are made near the center area which affect sound in ways similar to said large center hole. These holes must be grouped together in sufficiently close proximity to achieve results similar to a single large hole. If these holes are close enough together, they will alter the vibration of the instrument in a way which reduces the hum note and obliterates the center node found in conventional cymbals.

Further evidence that this invention is not a gong is that it even when it is struck with gong mallets it still sounds more like a cymbal than a gong. When very large versions of the invention were struck with very soft gong mallets, it can sound like a cross between a cymbal and a gong. The invention is primarily designed for striking with drumsticks.

Slotting Used in Combination with the Center Hole:

The embodiments shown in the accompanying drawings are round but other shapes could be utilized. The embodiments shown have a domed shape. Such a domed surface will have a louder and more complex sound than a flat shape.

For example, a dome shape with a large radius of 40 inches will tend to resemble a cymbal in sound, while a dome shape with a smaller radius of 12 inches will tend to resemble a bell in sound.

Round shapes will produce sounds which most resemble cymbals, but other shapes can be used.

Nickel-iron Grain Refiners in Bronze Percussion Instruments:

While ductility is necessary to form the shapes in this invention, the final product must be exceedingly strong and resilient to withstand consumer use. It must hence resist deformation during use while being quite flexible. In many alloys, the metal is quite ductile (easily deformed without cracking or failure) when in the soft or partially softened state. These softer states of metal, while quite ductile, are not as strong as the hardened levels of temper in any given alloy. Temper ratings of certain alloys, especially those which are strengthened through cold work methods such as rolling, hammering or other methods which can reduce the thickness of said metal and reduce grain size and elongate the grain structure of the alloy, are rated by the percent of elongation remaining in the alloy before the metal will fail in tension.

Phosphor bronze is hardened and strengthened by cold work. Phosphor bronze alloys are typically composed of copper, tin and a small amount of phosphorous. A typical phosphor bronze, when hardened to a strength rating of extra spring temper, can only be elongated by an additional 2% before failing and breaking or cracking in tension.

The addition of small amounts of iron and nickel can refine and reduce grain size and hence, increase strength. Through the addition of said iron and nickel, ideally in ranges of between 0.05 to 0.20% each, can increase strength considerably. By utilizing these grain refiners, a temper with more elongation remaining in the alloy can be used.

A temper rating of extra hard in such an alloy, will possess strength equal to extra spring in a typical bronze alloy. This extra hard temper can be elongated considerably more than extra spring temper hence allowing the deformation needed to easily form this invention.

In short, a softer and more ductile temper of grain refined bronze can be stronger than a hard, more brittle temper of traditional bronze. While nickel iron grain refiners are known to increase low tin bronze strength, they are not known to increase sound quality. Low tin bronze alloys are thought to be to high pitched, and of narrow range compared to equal high tin alloys in sound quality.

The inventor has found that by using nickel iron grain refiners in low tin, more affordable and workable alloys, a percussion or cymbal maker can increase taper, use of heat zones, depth and greater variations of hammering and other processes which create a structurally more complex instrument to realize a product of superior complexity of overtone structure, higher strength and a product which lends itself to greater affordability of quality control. Such processes such as greatly increased tapering would weaken common alloys but the added strength provided by nickel iron grain refiners allows the use of these special processes and features.

Many bronze instruments shared many vibrational characteristics with cymbals. Advertising copy from the two largest cymbal manufacturers teaches away from the use of low tin alloys for high quality percussion instruments by mentioning that their own product lines made of low tin alloys are of affordable, mass produced and identical quality when compared to their high tin alloy products. The Web site related to Sabian.com advertising refers to low tin alloy called B8 phrases point to an image of affordability: "rapid tech virtual cloning"; limited range of overtone structure is advertised: "focused sound"; and "lowest possible prices" all teach away from low tin alloys for use in quality cymbals and percussion. The Zildjian company (the largest cymbal maker) advertises "ultra modern crafting techniques", "higher pitch", "more focused overtones", and "identical discs" for their low tin products. Such phrases teach away from very high quality to cymbal and percussion consumers, who regard hand crafting and a wider range of overtones desirable. See http://www-.zildjian.com/en-US/products. Conversely the same companies promote their high tin products as works of art with centuries old secret processes which yield high quality, all of which begins with their 20% tin alloy.

The use of nickel-iron grain refiners in this invention offers a method to create new percussion instrument embodiments of high quality and novel sound while possessing the superior flexural strength need for this invention.

DETAILED DESCRIPTION OF THE INVENTION

Figure 1:
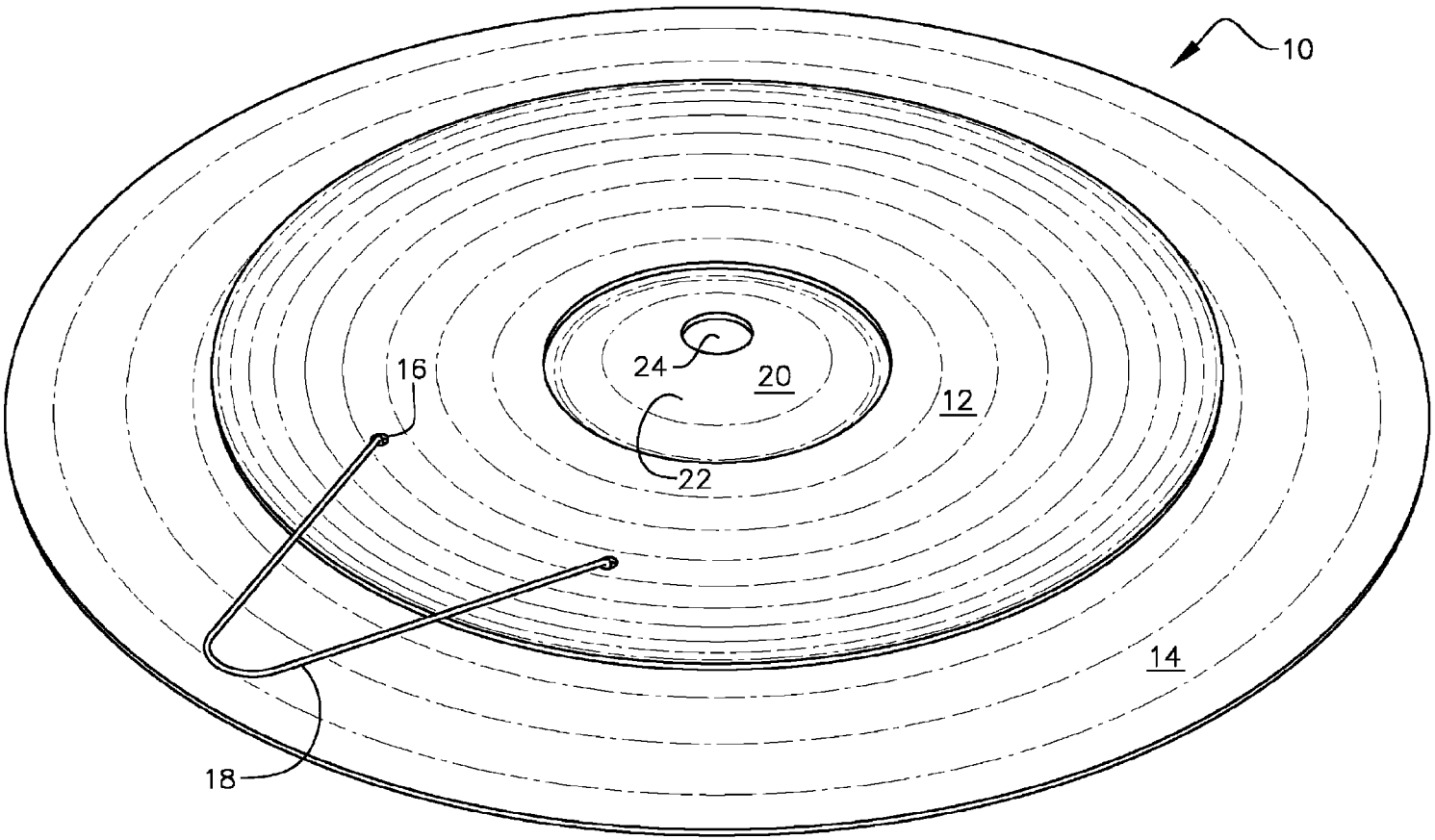
FIG. 1 is an example of a hybrid percussion instrument similar to that of FIG. 2 described below, which is being used as a quick-change rattle instrument in combination with a cymbal which can be mounted on a cymbal stand (not shown)

The invention is a quick change rattle device 10 which comprises a suspendable instrument 12 which is used with a mounting cord 18 for temporary suspension with the chord or lanyard 18 attached to suspension points 16. A large center hole 20 can allow the instrument to be instantly placed upon a conventional cymbal 14 to create quick change rattle device 10. Such a device can emit a loud rattling sound when struck while resting on top of a cymbal 14. The dome shape 22 and large center hole 20 of the invention can be self centering on a cymbal 14, but this self-centering feature is not necessary.

If the hole 20 is slightly larger than the wing nut and felt washer (not shown but well understood in the art of mounting cymbals on a cymbal stand), a resonant air cavity will result and alter the frequency response of the cymbal 14. This embodiment would hide the center cup of the cymbal 14 which is often used as a striking point on the cymbal 14. If the hole 20 is larger than the cup of the cymbal 14, than the cup will be exposed and allow the cup to be struck. This embodiment also creates a gap around the inside of the hole between the device and the cymbal which allows faster removal of the device.

Ideally the dome 20 of the invention should be of a lower height than the combined height of the cup of the cymbal 14 below and the wing nut assembly which holds the conventional cymbal 14 on a cymbal stand (not shown) using aperture 24 on the cymbal 14. The wing nut assemble would act as a stop and prevent the instrument from falling if the cymbal below is tilted. This embodiment of the invention is also quite effective in use with hi-hat cymbal assemblies as it can alter the sound of the hi-hat in a useful and novel way.

In a preferred embodiment, the suspendable percussion instrument 12 has features that includes an approximately centered or slightly off centered hole 20, where the hole 20 is between 15 and 50% of the overall diameter of the instrument 12.

Multiple instruments can be stacked upon each other to alter their sound toward a more "staccato" or fast decay sound. If a suspension cord is used, invention can be very quickly removed from position as a rattle device and rehung upon a hook or other device from the suspension cord 18 to be used again as a suspended hybrid instrument. The invention can also be constructed without holes for use as a rattle.

The invention, in position as a rattle, can be used with vintage or other valuable cymbals without any permanent alteration to the cymbal. The air cavity between the rattle and the cymbal below serves to protect the cymbal from high velocity impact with drumsticks.

Objects can be welded to the suspended instrument to alter its sound while suspended or while used as a rattle. Slots or folds can be made in the invention to alter its performance. Rattles with very large holes in relation to diameter can be utilized to act as multiple ring-like rattles. Spirals and rings or bands, or spirals of various metals and other materials can also be used as quick change rattles. If the ring-like shapes of differing diameter are utilized simultaneously on the same cymbal, they would all rattle or vibrate at differing frequencies to yield a complex sound effect.

Figure 2:
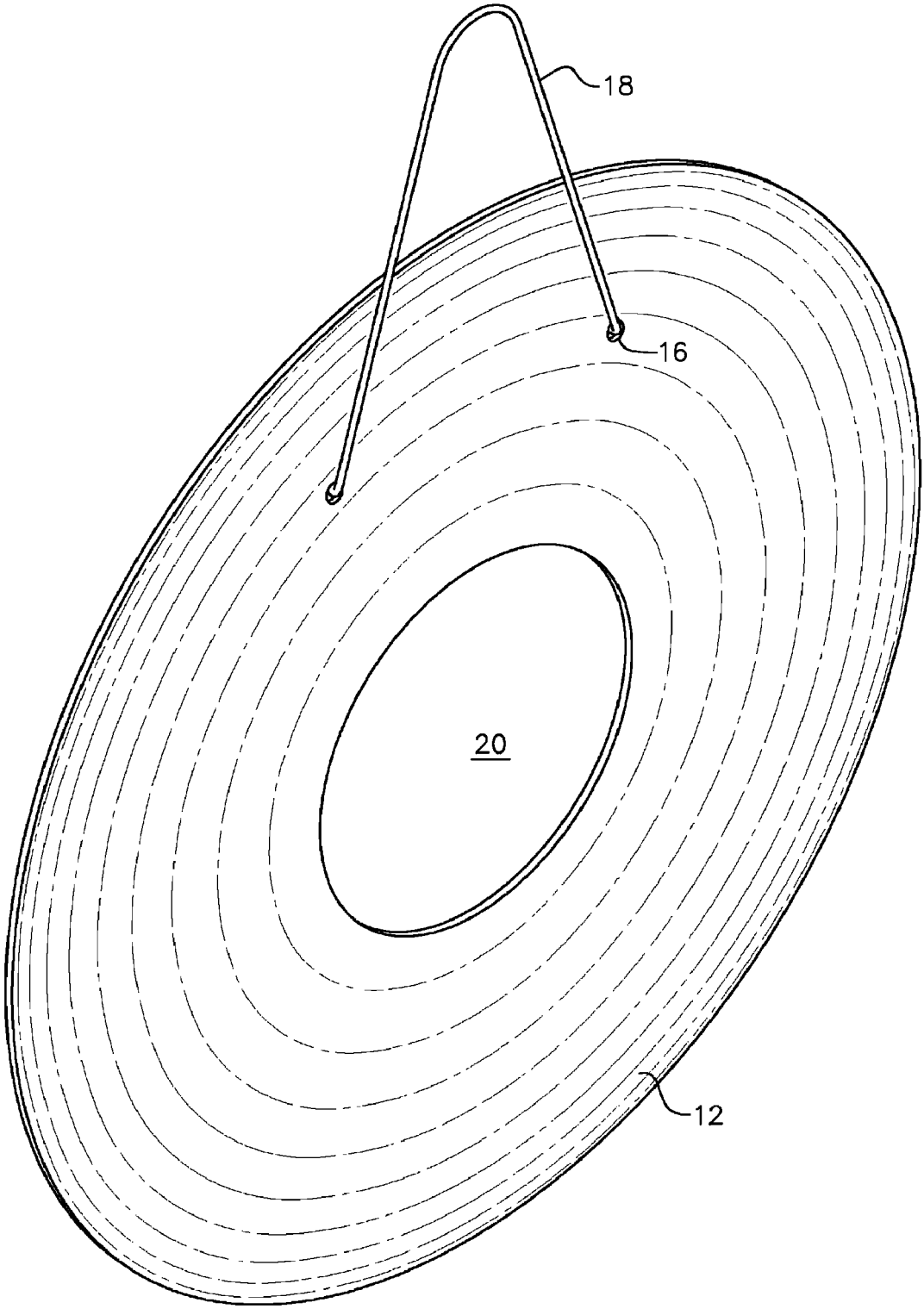
FIG. 2 is a conceptual representative drawing of a suspendable hybrid percussion instrument with a large center hole contemplated by the present invention.

As shown in FIG. 1, the invention comprises a hybrid percussion instrument 12 similar to that of FIG. 2, which is being used as a quick-change rattle instrument 10 in combination with another percussion instrument, in the example depicted, a cymbal 14 adapted to be mountable on a cymbal stand (not shown).

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

The invention claimed is:

1. A method for using a rattle with a cymbal, the rattle including a sheet of metal with a hole defined therein, the method comprising:

arranging the rattle over, and in contact with, the cymbal such that a central cup or bell of the cymbal extends through a hole in the rattle, wherein the hole is between approximately 15 percent and approximately 50 percent of an overall diameter of the rattle;

with the rattle arranged over the cymbal, striking the cymbal or the rattle to produce an altered sound; and independently suspending the rattle by a mounting cord attached to at least one suspension point and striking the rattle alone.

2. The method of claim 1, wherein the sheet of metal is permanently curved in a dome shape having a curvature radius.

3. The method of claim 2, wherein the curvature radius approximates that of the cymbal.

4. The method of claim 3, wherein the curvature radius is approximately 40 inches.

5. The method of claim 3, wherein the curvature radius is approximately 12 inches.

6. The method of claim 2, wherein a height of the dome shape is less than a height of the cymbal.

7. A hybrid cymbal instrument comprising:

a sheet of metal having a permanent dome shape and a hole defined approximately centrally thereto, the sheet of metal completely surrounding the hole, wherein the sheet and hole are dimensioned such that, when the instrument is placed over a cymbal having a central cup or bell, the central cup or bell extends through the hole; and a mounting cord attached to at least one suspension point on the sheet of metal for independently suspending the sheet of metal and striking the sheet of metal alone;

wherein the hole is between approximately 15 percent and approximately 50 percent of an overall diameter of the instrument.

8. The instrument of claim 7, wherein a perimeter of the instrument is substantially circular.

9. The instrument of claim 7, wherein the metal is a phosphor bronze alloy.

10. A method of minimizing hum notes in a hybrid cymbal instrument formed of a sheet of metal, the method comprising:

a sheet of metal having a permanent dome shape and a hole defined approximately centrally thereto, the sheet of metal completely surrounding the hole, wherein the sheet and hole are dimensioned such that, when the instrument is placed over a cymbal having a central cup or bell, the central cup or bell extends through the hole; and a mounting cord attached to at least one suspension point on the sheet of metal for independently suspending the sheet of metal and striking the sheet of metal alone; wherein the hole is between approximately 15 percent and approximately 50 percent of an overall diameter of the instrument.

11. The method of claim 10, wherein the hole is centered on the instrument.

12. The method of claim 10, wherein the hole diameter is less than approximately 50% of the instrument diameter.

* * * * *